US008482498B2

(12) United States Patent
Lin et al.

(10) Patent No.: US 8,482,498 B2
(45) Date of Patent: Jul. 9, 2013

(54) LIQUID CRYSTAL DISPLAY PANEL

(75) Inventors: Shu-Hao Lin, Hsinchu (TW); Ying-Ying Chen, Hsinchu (TW); Chun-Kai Lai, Hsinchu (TW); Chao-Cheng Lin, Hsinchu (TW); Yen-Hua Hsu, Hsinchu (TW)

(73) Assignee: Au Optronics Corp., Hsinchu (TW)

( * ) Notice: Subject to any disclaimer, the term of this patent is extended or adjusted under 35 U.S.C. 154(b) by 994 days.

(21) Appl. No.: 12/535,124

(22) Filed: Aug. 4, 2009

(65) Prior Publication Data

US 2010/0117944 A1 May 13, 2010

(30) Foreign Application Priority Data

Nov. 7, 2008 (TW) ..... 97143184 A

(51) Int. Cl.
*G09G 3/36* (2006.01)

(52) U.S. Cl.
USPC ..... 345/87; 345/204; 345/55

(58) Field of Classification Search
USPC ..... 345/204, 205, 55, 76, 84, 87–88, 345/90
See application file for complete search history.

(56) References Cited

U.S. PATENT DOCUMENTS

| | | | | |
|---|---|---|---|---|
| 5,598,010 | A | 1/1997 | Uematsu | |
| 6,064,222 | A * | 5/2000 | Morita et al. | 324/750.3 |
| 7,358,955 | B2 | 4/2008 | Lim | |
| 7,633,469 | B2 * | 12/2009 | Kawata | 345/76 |
| 8,018,402 | B2 * | 9/2011 | Kim et al. | 345/76 |
| 8,023,059 | B2 * | 9/2011 | Chung et al. | 349/54 |
| 8,232,984 | B2 * | 7/2012 | Kwon et al. | 345/205 |
| 2007/0146002 | A1 * | 6/2007 | Hsieh et al. | 324/770 |
| 2008/0068309 | A1 * | 3/2008 | Kwak et al. | 345/82 |

FOREIGN PATENT DOCUMENTS

| | | |
|---|---|---|
| JP | 62-194628 | 8/1987 |
| JP | 63-236319 | 10/1988 |
| JP | 2002-350802 | 12/2002 |
| JP | 2003-241211 | 8/2003 |

* cited by examiner

*Primary Examiner* — Jason Mandeville
(74) *Attorney, Agent, or Firm* — John P. Fonder

(57) ABSTRACT

A liquid crystal display panel includes a display region, a periphery circuit region, a joint obligate region, a plurality of first test thin-film transistors (TFTs), a plurality of second TFTs, a plurality of first lines, a plurality of second lines, a blank region, and at least one first adjustment TFT. The first and second test TFTs are disposed on the joint obligate region according to a regular distance. Each of the first and second test TFTs has a transistor width. The first adjustment TFT is disposed on the blank region. The width of the blank region is not smaller than the sum of the twice regular distance and the transistor width. Thereby, the present invention can prevent the band mura of the liquid crystal display panel effectively when the liquid crystal display panel is in testing.

13 Claims, 8 Drawing Sheets

LIQUID CRYSTAL DISPLAY PANEL

This application claims the benefit from the priority of Taiwan Patent Application No. 097143184 filed on Nov. 7, 2008, the disclosure of which are incorporated by reference herein in their entirety.

CROSS-REFERENCES TO RELATED APPLICATIONS

Not applicable.

BACKGROUND OF THE INVENTION

1. Field of the Invention

The present invention relates to a liquid crystal display panel. More particularly, the present invention relates to a liquid crystal display panel capable of preventing the formation of a band mura during a test period.

2. Descriptions of the Related Art

Over recent years, flat panel displays have developed rapidly and gradually replaced conventional cathode ray tube (CRT) displays. Among various flat panel displays, liquid crystal displays (LCDs) are renowned as mainstream products. As liquid crystal displays have been more widely used in automobiles and mobile products, the demands for medium- and small-sized panels grow increasingly. At the back end of the line (BEOL) during production of such medium- and small-sized LCD panels, manufacturers typically test whether the display function of the liquid crystal display panels works properly by inputting the voltage signal to the panels from a test circuit through a shorting bar. After the completion of the test at the back end of the line, the manufactures will cut off the shorting bar with a laser so that the scan lines, data lines and the test circuit are separated from each other as required for the proper operation of the liquid crystal display panels. Due to the demand of the simple manufacturing process, manufacturers now have gradually utilized thin-film transistors (TFTs) to replace the shorting bars for controlling the voltage signal from the test circuit when it has been inputted to the liquid crystal display panel.

In such conventional liquid crystal display panels, a plurality of thin-film transistors are used to electrically connect with individual scan lines, data lines and the test circuit, and works together with the test circuit to test whether the displaying function of the liquid crystal display panels works properly. When testing a liquid crystal display panel, the manufacturers turn on the thin-film transistors with the test circuit. Then, via the thin-film transistors, the voltage signal from the test circuit is inputted into the individual scan lines and data lines of the liquid crystal display panel to perform the test on the panel. After the completion of the test, the test circuit is electrically connected to a voltage supply so that the thin-film transistors will remain in the off state. In this way, by using the thin-film transistors to control the voltage signal from the test circuit when it has been inputted to the liquid crystal display panel, the back end of the line can be simplified considerably.

However, because the density and locations of the thin-film transistors in the liquid crystal display panel are not consistent across the panel, variations in the thin-film transistors may arise due to the loading effect during the manufacturing process. Consequently, when the voltage signal from the test circuit is inputted to the individual scan lines and data lines of the liquid crystal display panel via the thin-film transistors during the test, variations in electrical characteristics of the thin-film transistors, especially the greater variations in electrical characteristics between the thin-film transistors adjacent to the blank region and those far from the blank region, will cause a band mura in the liquid crystal display panel. This causes a significantly increased probability of the manufacturers misjudging such liquid crystal display panels as defective due to the band mura during the test period.

Accordingly, efforts still have to be made by the manufacturers to prevent the formation of a band mura in display regions during the test of liquid crystal display panels to decrease the probability of misjudging liquid crystal display panels as defective.

SUMMARY OF THE INVENTION

The primary objective of this invention is to provide a liquid crystal display panel, which comprises a display region, a periphery circuit region, a joint obligate region, a plurality of first test thin-film transistors, a plurality of second test thin-film transistors, a plurality of first lines, a plurality of second lines, a blank region and at least one first adjustment thin-film transistor. The periphery circuit region is situated at a periphery of the display region. The joint obligate region is situated at the periphery circuit region. The first test thin-film transistors, each of which has a transistor width, are disposed on the joint obligate region according to a regular distance, wherein every two adjacent first test thin-film transistors have a pitch which has a width equal to a sum of the transistor width and the regular distance. The second test thin-film transistors, each of which has the transistor width, are disposed on the joint obligate region according to a regular distance, wherein every two adjacent second test thin-film transistors have the pitch. Each of the first line terminals is electrically connected to one of the corresponding first test thin-film transistors individually and each of the second line terminals is electrically connected to the display region individually. Each of the second line terminals is electrically connected to one of the corresponding second test thin-film transistors individually and each of the second line terminals is electrically connected to the display region individually. The blank region has a width and is formed between the first and the second test thin-film transistors. The first adjustment thin-film transistor is disposed on the blank region. The width of the blank region is not smaller than the sum of twice the regular distance and the transistor width.

According to the above description, by disposing the adjustment thin-film transistors and the adjustment lines, the liquid crystal display panel disclosed in this invention can prevent band muras from forming on conventional liquid crystal display panels during the testing periods.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

In the following description, this invention will be explained with reference to embodiments thereof. This invention provides a liquid crystal display panel. However, the description of these embodiments is only for purposes of illustration rather than limitation. It should be appreciated that in the following embodiments and the attached drawings, elements unrelated to this invention are omitted from depiction; and the dimensional relationships among individual elements in the attached drawings are illustrated only for ease of understanding, but not to limit the actual scale.

Figure 1:
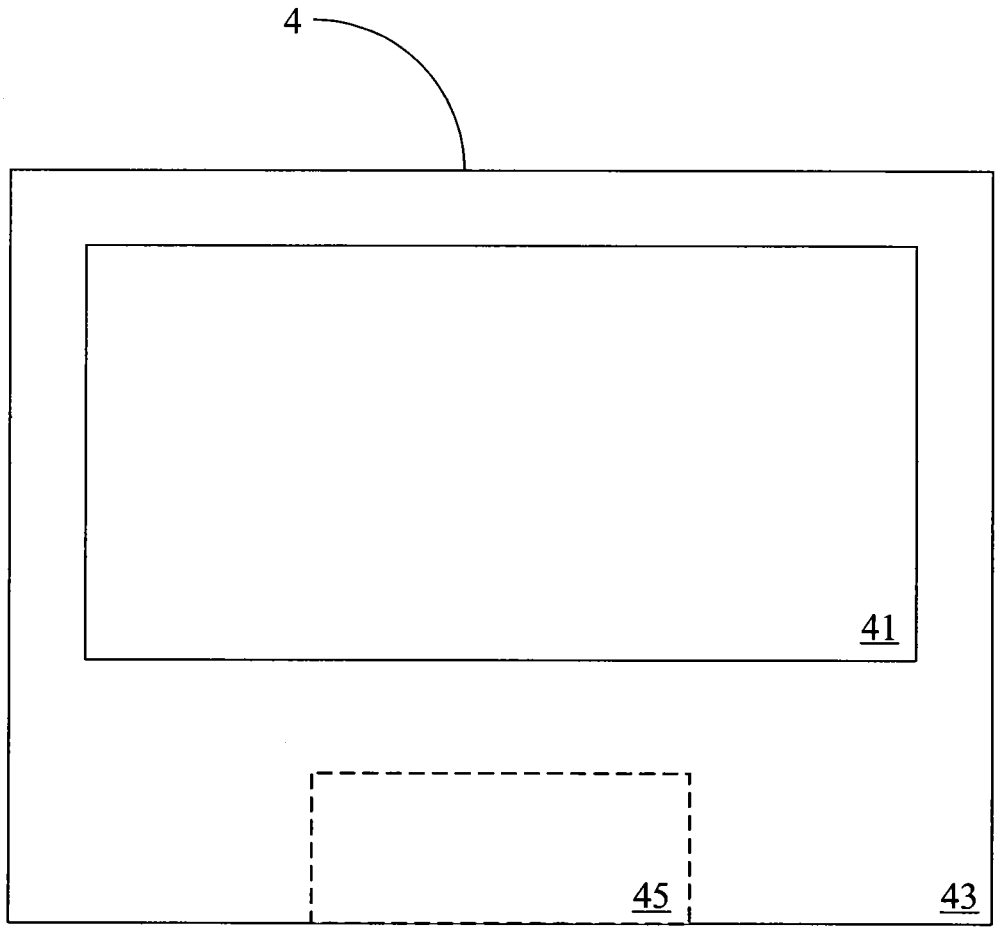
FIG. 1 is a schematic view of a liquid crystal display panel of this invention.
Figure 2:
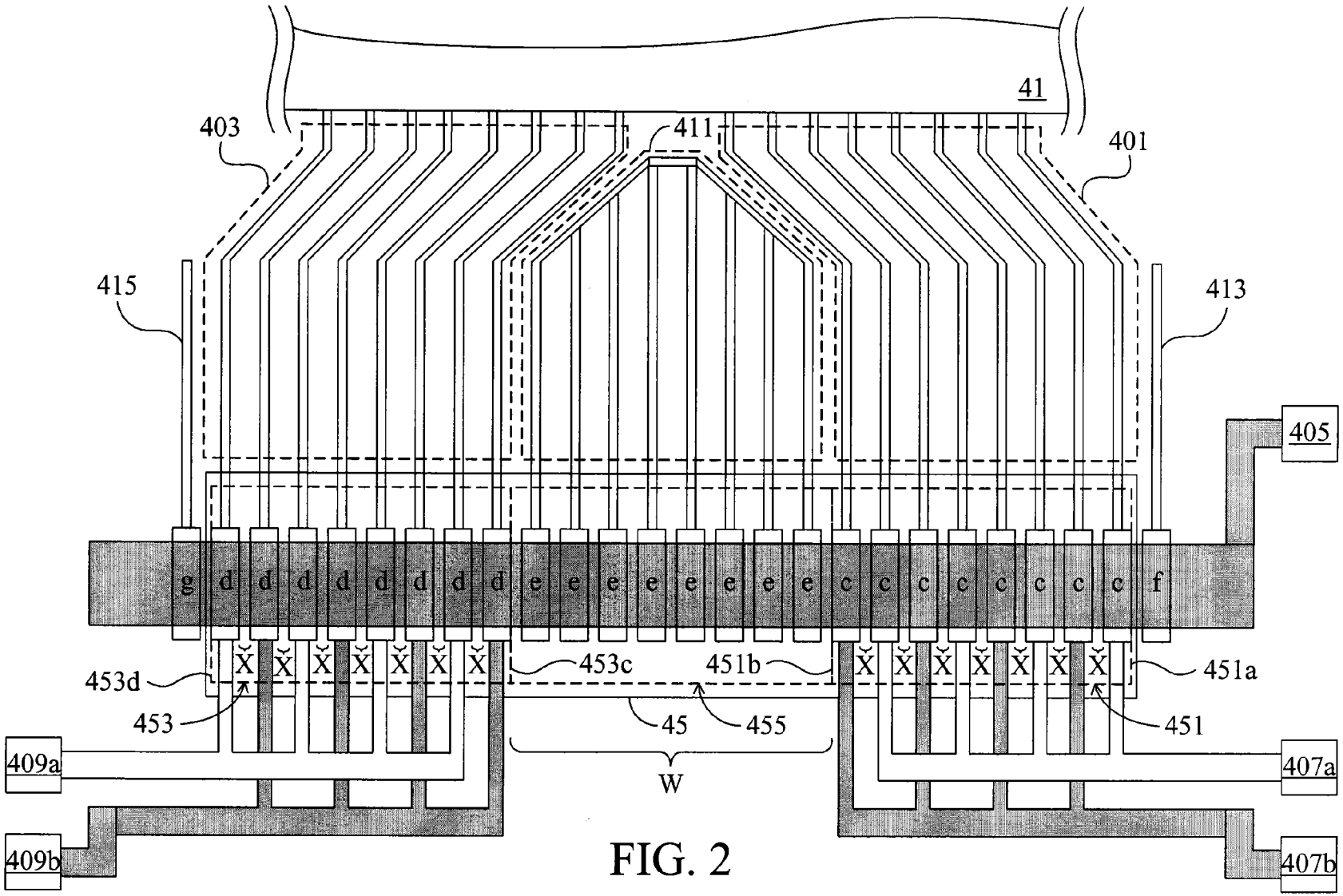
FIG. 2 is a schematic view of a preferred embodiment of the liquid crystal display panel of this invention.

FIG. 1 is a schematic view of a liquid crystal display panel 4. The liquid crystal display panel 4 comprises a display region 41, a periphery circuit region 43 and a joint obligate region 45. The display region 41 is the region where the liquid crystal display panel 4 displays an image. The periphery circuit region 43 is situated at a periphery of the display region 41. The joint obligate region 45, which is situated in the periphery circuit region 43, may be a region reserved in the periphery circuit region 43 for bonding a chip. FIG. 2 depicts an embodiment of the liquid crystal display panel of this invention, which comprises a plurality of first test thin-film transistors c, a plurality of second test thin-film transistors d, a plurality of first lines 401, a plurality of second lines 403, a gate test pad 405, at least one first test pad 407*a*, 407*b* and at least one second test pad 409*a*, 409*b*. Each of the first lines 401 is electrically connected to a corresponding one of the first test thin-film transistors c and the display region 41, while each of the second lines 403 is electrically connected to a corresponding one of the second test thin-film transistors d and the display region 41 respectively. Through the at least one first test pad 407*a*, 407*b* and the at least one second test pad 409*a*, 409*b*, the first test thin-film transistors c and the second test thin-film transistors d can control whether a voltage signal has been inputted to the display region 41 of the liquid crystal display panel 4 to test for abnormal conditions thereof.

More specifically, the voltage signal of the at least one first test pad 407*a*, 407*b* is inputted to the display region 41 via the first test thin-film transistors c and the corresponding first lines 401; while the voltage signal of the at least one second test pad 409*a*, 409*b* is inputted to the display region 41 via the second test thin-film transistors d and the corresponding second lines 403. In the preferred embodiment, the at least one first test pad is a plurality of first test pads, while the first test pads 407*a* and the first test pads 407*b* may be electrically connected to the first test thin-film transistors c alternately. The at least one second test pad is a plurality of second test pads, of which second test pads 409*a* and second test pads 409*b* may be electrically connected to the second test thin-film transistors d alternately. By connecting the first test pads 407*a*, 407*b* alternately and providing two adjacent first lines 401 with signal sources that have a phase difference, it is helpful to determine which first line 401 is defective. Likewise, by connecting the second test pads 409*a*, 409*b* alternately and providing two adjacent second lines 403 with signal sources that have a phase difference, it is helpful to determine which second line 403 is defective. The number of first test pads (or second test pads) is not limited to what is illustrated herein, but may be adjusted depending on the practical conditions. For example, there may be three first test pads electrically connected to the first test thin-film transistors alternately. The connections and distributions thereof will be readily appreciated by those of ordinary skill in the art based on the above description and, thus, will not be further described herein.

In reference to FIG. 2, the first test thin-film transistors c and the second test thin-film transistors d are disposed on the joint obligate region 45 (shown in FIG. 1) according to a regular distance X respectively. The first test thin-film transistors c may form a first test region 451 with a first side 451*a* and a second side 451*b* opposite each other. Likewise, the second test thin-film transistors d may form a second test region 453 with a third side 453*c* and a fourth side 453*d* opposite each other. Between the first test thin-film transistors C with the regular distance X and the second test thin-film transistors d with the regular distance X, a blank region 455, which is adjacent to the second side 451*b* of the first test region 451 and the third side 453*c* of the second test region 453, is formed. The blank region 455 has a width W.

Figure 3:
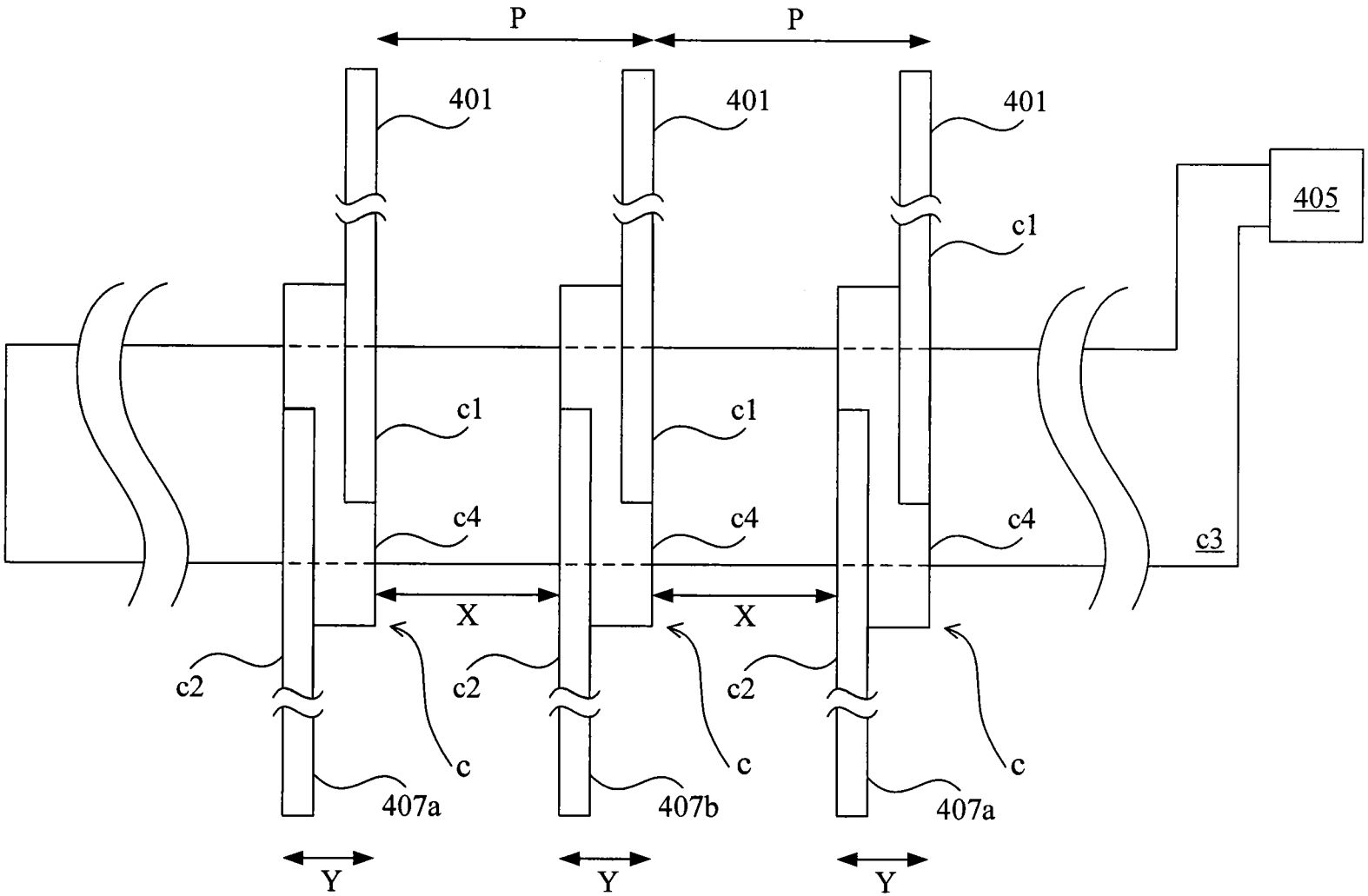
FIG. 3 is a schematic view of the first test thin film transistors in the liquid crystal display panel of this invention.

FIG. 3 depicts a schematic structural view of the first test thin-film transistors C. Each of the first test thin-film transistors C has a drain electrode c1, a source electrode c2 and a gate electrode c3. Each of the first test thin-film transistors C has a transistor width Y. The drain electrodes c1 are electrically connected to the first lines 401 individually, while the source electrodes c2 are electrically connected to the first test pads 407*a*, 407*b* individually. The gate electrodes c3 are electrically connected to the gate test pad 405. Every two adjacent first test thin-film transistors C have a pitch P, which is equal to the sum of the transistor width Y and the regular distance X. Each of the first test thin-film transistors c has an isolation layer c4 for isolation between the gate electrode c3 and the source electrode c2 and between the gate electrode c3 and the drain electrode c1. The second test thin-film transistors d are similar to the first test thin-film transistors c conceptually, and thus will not be described again herein.

In reference to both FIGS. 2 and 3, it should be noted that the width W of the blank region 455 is not smaller than a sum of twice the regular distance X and the transistor width Y (i.e. $W \geqq Y+2X$). In the preferred embodiment, the width W of the blank region 455 may be substantially larger than 1.4 times the width of the pitch P, the width W of the blank region 455 may be substantially larger than 18 μm, and the width of the pitch P of the first test thin-film transistors c and the second test thin-film transistors d may substantially range from 12 μm to 17 μm. For example, if the width of the pitch P is 16 μm and the regular distance X is 8 μm, then a first adjustment thin-film transistor e can be disposed when the width W of the blank region 455 is 24 μm. However, rather than being limited thereto, these may also be adjusted depending on the practical needs.

More specifically, because the gate test pad 405 is electrically connected to the gate electrodes c3 of the first test thin-film transistors c and the gate electrodes d3 of the second test thin-film transistors d, the on-off status (i.e whether turned on or off) of the first thin-film transistors c and the second test thin-film transistors d can be controlled by the gate test pad 405.

Again, in reference to both FIGS. 2 and 3, because the width W of the blank region 455 is not smaller than the sum of twice the regular distance X and the transistor width Y (i.e. $W \geqq Y+2X$), at least one first adjustment thin-film transistor e can be disposed on the blank region 455 to eliminate the band mura caused by the blank region 455 to the liquid crystal display panel. The at least one first adjustment thin-film transistor e may be a plurality of first adjustment thin-film transistors e, which are disposed on the blank region 455 according to a regular distance X. According to the width W, the first adjustment thin-film transistors e may be disposed from both sides of the blank region 455 (i.e. the second side 451*b* of the first test region 451 and the third side 453*c* of the second test region 453) towards the centre according to the regular distance X until no more adjustment thin-film transistors e can be disposed. In other words, beginning from both sides of the blank region 455, first adjustment thin-film transistors e are disposed towards the centre according to the regular distance X until the remaining region at the center of the blank region 455 is smaller than the sum of twice the regular distance X and the transistor width Y.

Additionally, a plurality of first adjustment lines 411 may be provided in this invention, each of which has an electrically connected terminal to the corresponding first adjustment thin-film transistors e. The first adjustment lines 411 have another terminal connected to each other to form a closed connection terminal to prevent damage to the components attributed to electrostatic discharge (ESD). It should be appreciated that this invention is not limited to the configuration in which the other terminals of the first adjustment lines 411 are connected to each other to form a closed connection terminal. Other configurations in which the other terminals are not connected to each other may also be used depending on practical needs. Also, the length of the first adjustment lines 411 is not limited in this invention, but may be regulated along the edges of the first lines 401 and the second lines 403. For example, in FIG. 2, the length of the first adjustment lines 411 is regulated along the edges of the first lines 401 and the second lines 403 so that the closed connection terminal is formed into a trapezoid. If the first lines 401 and the second lines 403 are electrically connected to the display region 41 in parallel to each other, the length of the first adjustment lines 411 will be regulated along the edges of the first lines 401 and the second lines 403 so that the closed connection terminal is formed into a rectangle (as shown in FIG. 8).

It should be noted that this invention has no limitation on the number of the first adjustment thin-film transistors e. Rather, according to the width W of the blank region 455, the first adjustment thin-film transistors e may be disposed from both sides of the blank region 455 (i.e. the second side 451*b* of the first test region 451 and the third side 453*c* of the second test region 453) towards the centre according to the regular distance X until no more adjustment thin-film transistors e can be disposed. Additionally, the number of the first adjustment lines 411 may correspond to the number of the first adjustment thin-film transistors e.

Besides the first adjustment thin-film transistors e disposed on the blank region 455, the liquid crystal display panel 4 depicted in FIG. 2 may further comprise a second adjustment thin-film transistor f adjacent to the first side 451*a* of the first test region 451. The second adjustment line 413 has a terminal thereof electrically connected to the second adjustment thin-film transistor f. The liquid crystal display panel 4 depicted in FIG. 2 may further comprise a third adjustment thin-film transistor g adjacent to the fourth side 453*d* of the second test region 453. The third adjustment line 415 has a terminal thereof electrically connected to the third adjustment thin-film transistor g. The numbers of the second adjustment thin-film transistors f and the third adjustment thin-film transistors g are only provided for purposes of illustration, and may be adjusted depending on the practical needs. The numbers of the second adjustment lines 413 and the third adjustment lines 415 may correspond to the numbers of the second adjustment thin-film transistors f and the third adjustment thin-film transistors g respectively.

Figure 4:
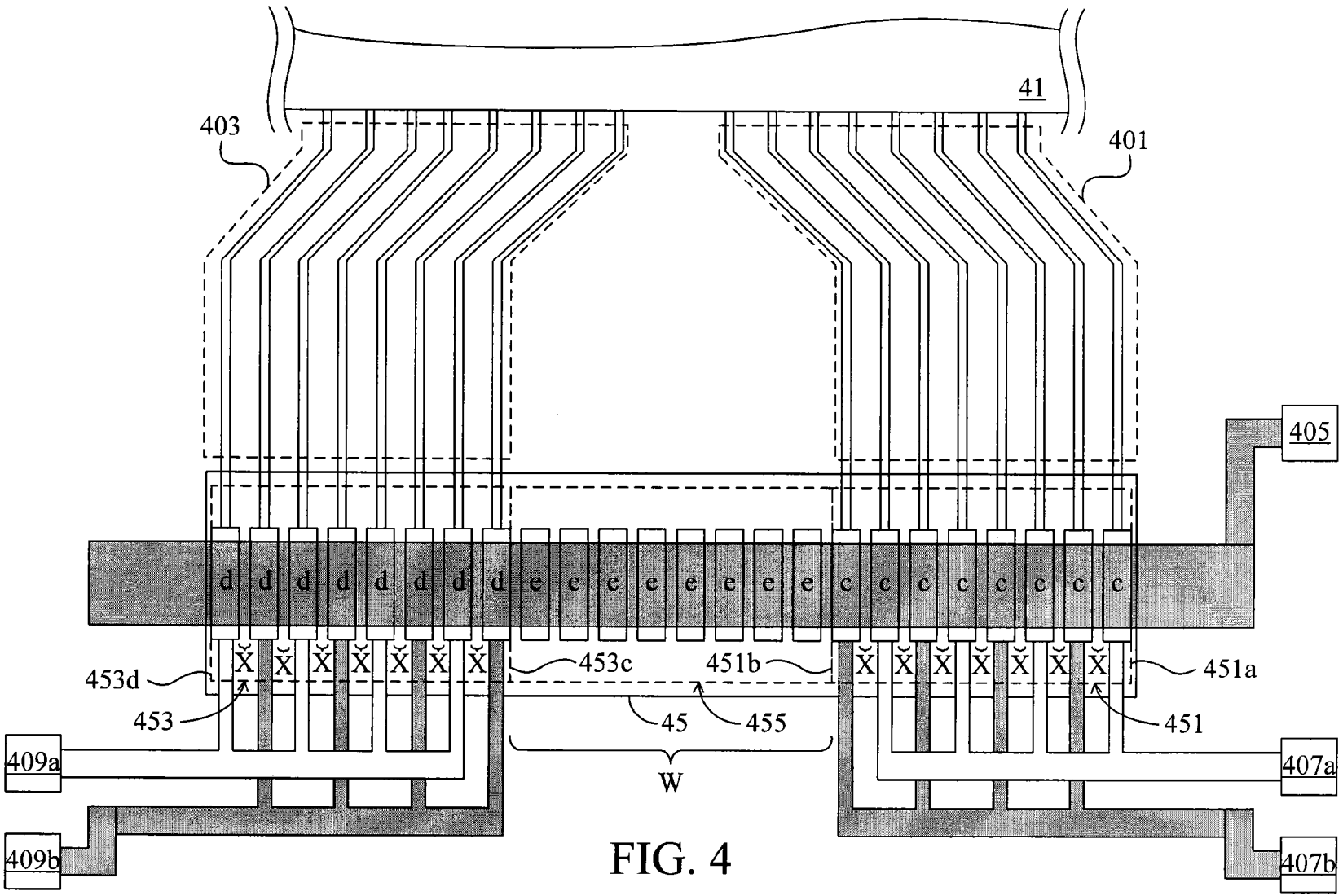
FIGS. 4 to 8 are schematic views of other preferred embodiments of the liquid crystal display panel of this invention.
Figure 5:
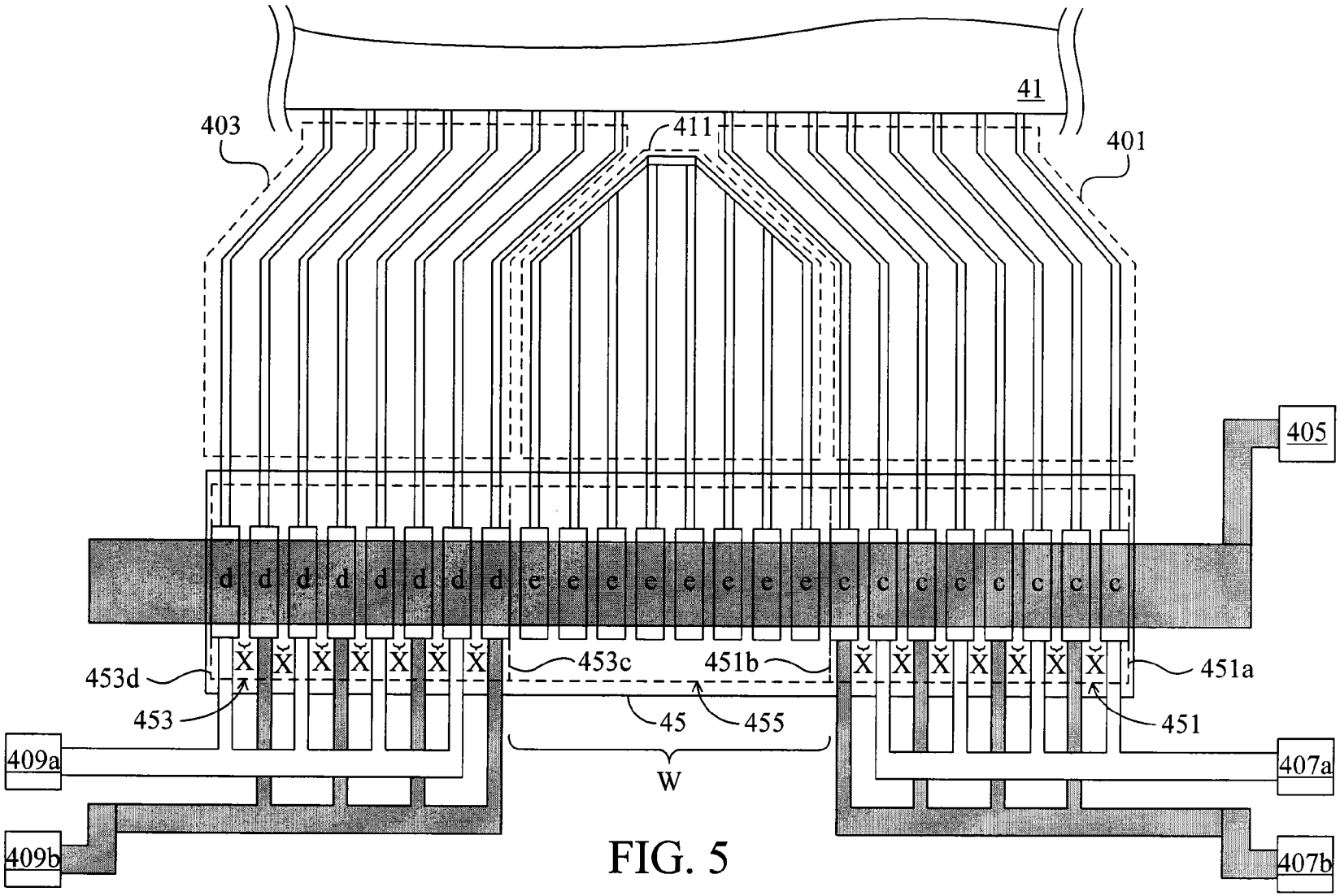
Figure 6:
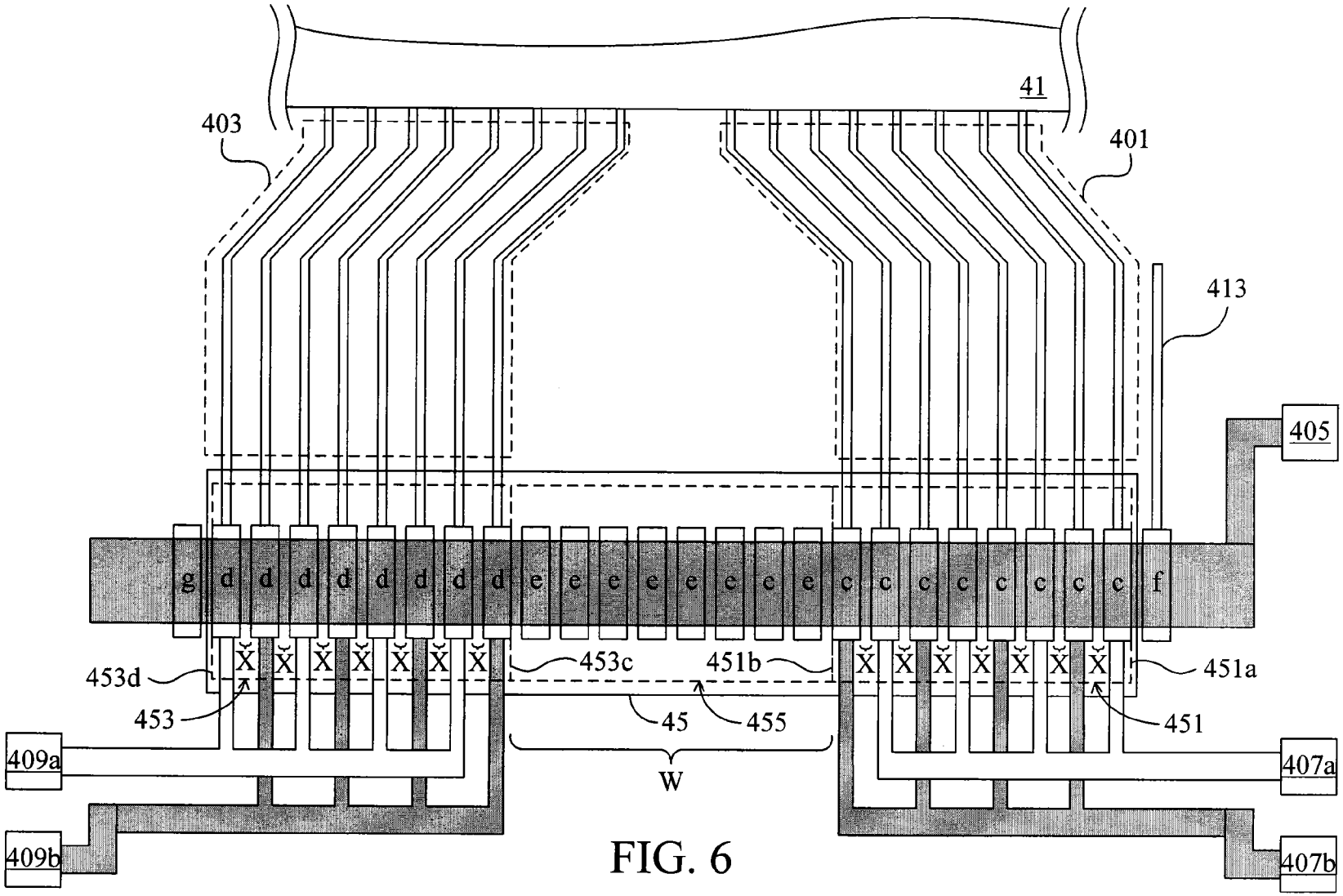
Figure 7:
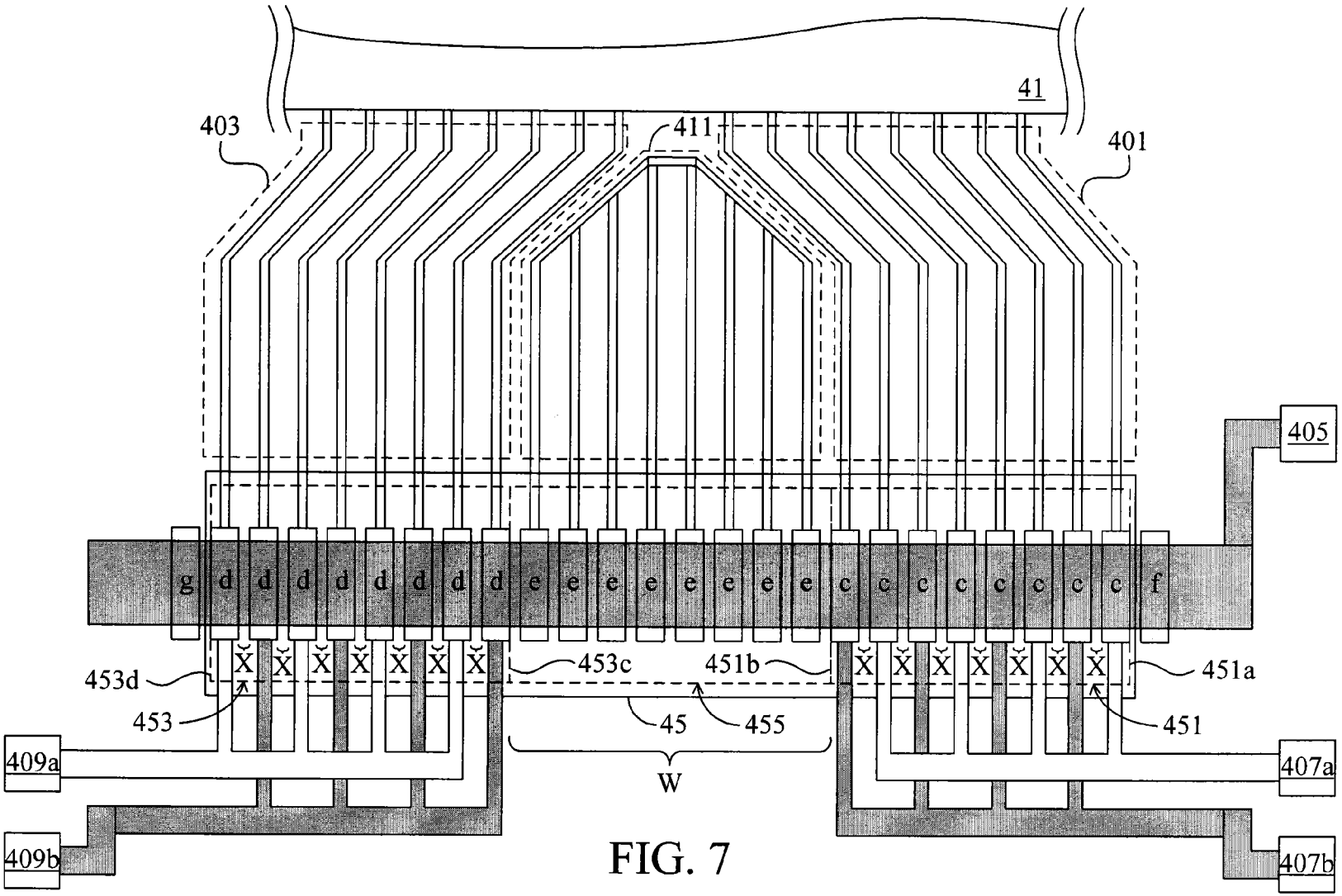
Figure 8:
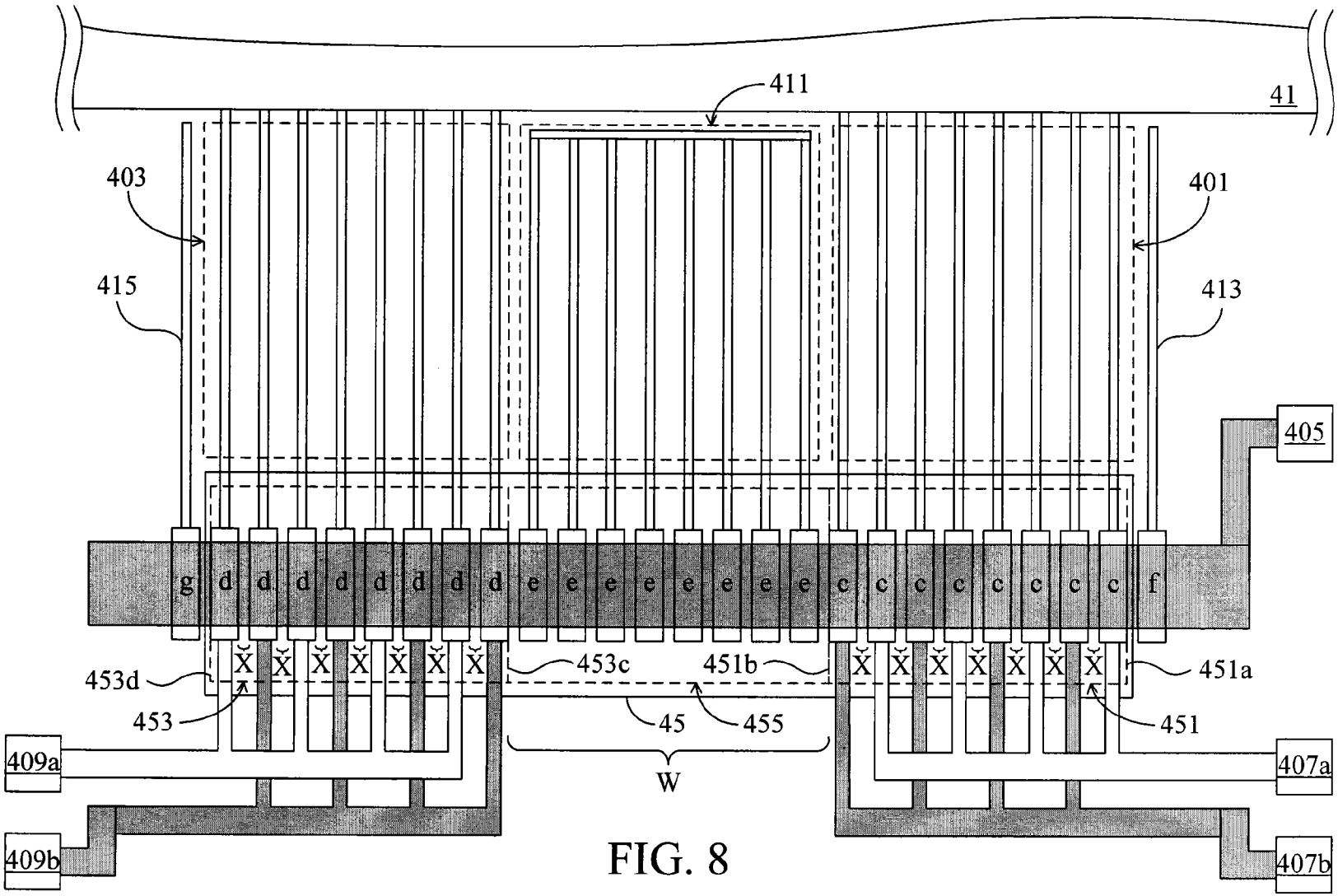

Besides the embodiment of the liquid crystal display panel 4 depicted in FIG. 2, other embodiments of the liquid crystal display panel 4 are also depicted in FIGS. 4 to 8. FIG. 4 depicts an embodiment which comprises only the first adjustment thin-film transistors e; FIG. 5 depicts an embodiment which comprises the first adjustment thin-film transistors e and the first adjustment lines 411; FIG. 6 depicts an embodiment which comprises only the first adjustment thin-film transistors e, the second adjustment thin-film transistors f and the third adjustment thin-film transistor g; and FIG. 7 depicts an embodiment which comprises the first adjustment thin-film transistors e, the second adjustment thin-film transistors f, the third adjustment thin-film transistor g and the first adjustment lines 411. FIG. 8 depicts the first lines 401 and the second lines 403 of the liquid crystal display panel 4 electrically connected to the display region 41 in parallel to each other. The first adjustment lines 411 electrically connected to the first adjustment thin-film transistors e are also parallel to each other. The preferred embodiment is the liquid crystal display panel 4 depicted in FIG. 2.

According to the above descriptions, when testing the display region 41 of the liquid crystal display panel 4 through the gate test pad 405, the first test pads 407*a*, 407*b* and the second test pads 409*a*, 409*b*, the gate test pad 405 will turn on the first test thin-film transistors c and the second test thin-film transistors d. Then via the first test thin-film transistors c and the second test thin-film transistors d, voltage signals from the first test pads 407*a*, 407*b* and the second test pads 409*a*, 409*b* will be inputted to the display region 41 via the first lines 401 and the second lines 403 respectively to carry out the test on the liquid crystal display panel 4.

Meanwhile, due to the first adjustment thin-film transistors e, both the second adjustment thin-film transistors f and the third adjustment thin-film transistor g may be disposed on the blank region 455 of the liquid crystal display panel 4. Hence, when the voltage signals from the first test pads 407*a*, 407*b* are inputted to the display region 41 via both the first test thin-film transistors c and the first lines 401, and the voltage signals from the second test pads 409*a*, 409*b* are inputted to the display region 41 via the second test thin-film transistors d and the second lines 403, the difference in the loading effect between the first test thin-film transistors c adjacent to the blank region 455 and those non-adjacent to the blank region 455 as well as the difference in the loading effect between the second test thin-film transistors d adjacent to the blank region 455 and those non-adjacent to the blank region 455 can be prevented to make the electrical characteristics more consistent, thereby eliminating the band mura in the display region 41. As a result, there is a lower probability of misjudgment during the test period and the production efficiency of the liquid crystal display panel is improved.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A liquid crystal display panel, comprising:

a display region;

a periphery circuit region being situated at a periphery of the display region;

a joint obligate region being situated in the periphery circuit region;

a plurality of first test thin-film transistors being disposed on the joint obligate region according to a regular distance, wherein each of the first test thin-film transistors has a transistor width, the adjacent two first test thin-film transistors have a pitch which has a width being equal to a sum of the transistor width and the regular distance;

a plurality of second test thin-film transistors being disposed on the joint obligate region according to the regular distance, wherein each of the second test thin-film transistors has the transistor width, and the adjacent two second test thin-film transistors have the pitch;

a plurality of first lines, each having a first terminal and a second terminal, the first terminal being electrically connected to one of the corresponding first test thin-film transistors individually, and the second terminal being electrically connected to the display region individually;

a plurality of second lines, each having a first terminal and a second terminal, the first terminal being electrically connected to one of the corresponding second test thin-film transistors individually, and the second terminal being electrically connected to the display region individually;

a blank region having a width, wherein the blank region is formed between the first and the second test thin-film transistors;

a plurality of first adjustment thin-film transistors, being disposed on the blank region and disconnected with the display region; and a plurality of first adjustment lines, each having a first terminal, the first terminal being electrically connected to one of the corresponding first adjustment thin-film transistors individually, wherein the first adjustment lines have second terminals, the second terminals are connected to each other to form a closed connection terminal, and the closed connection terminal is outside the display region and in the periphery circuit region, such that the first adjustment lines do not enter the display region;

wherein the width of the blank region is not smaller than a sum of the twice regular distance and the transistor width.

2. The liquid crystal display panel as claimed in claim 1, further comprising a gate test pad, being electrically connected to gate electrodes of the first and the second test thin-film transistors, being configured to control on-off of the first and the second test thin-film transistors.

3. The liquid crystal display panel as claimed in claim 1, further comprising at least one first test pad and at least one second test pad, wherein the at least one first test pad is electrically connected to source electrodes of the first test thin-film transistors, and the at least one second test pad is electrically connected to source electrodes of the second test thin-film transistors.

4. The liquid crystal display panel as claimed in claim 3, wherein the at least one first test pad is a plurality of first test pads, the first test pads are electrically connected to the source electrodes of the first test thin-film transistors alternately, the at least one second test pad is a plurality of second test pads, the second test pads are electrically connected to the source electrodes of the second test thin-film transistors alternately.

5. The liquid crystal display panel as claimed in claim 1, wherein the first adjustment thin-film transistors are disposed on the blank region according to the regular distance.

6. The liquid crystal display panel as claimed in claim 1, wherein the first test thin-film transistors are disposed on a first test region having a first side and a second side, the second test thin-film transistors are disposed on a second test region having a third side and a fourth side, the first side and the second side are opposite, the third side and the fourth side are opposite, and the blank region is adjacent to the second side of the first test region and the third side of the second test region.

7. The liquid crystal display panel as claimed in claim 6, further comprising at least one second adjustment thin-film transistor, wherein the at least one second adjustment thin-film transistor is disposed outside the first test region and adjacent to the first side of the first test region, and the at least one second adjustment thin-film transistor is disconnected with the display region.

8. The liquid crystal display panel as claimed in claim 7, further comprising at least one second adjustment line having a terminal, wherein the terminal of the at least one second adjustment line is connected to the at least one second adjustment thin-film transistor.

9. The liquid crystal display panel as claimed in claim 6, further comprising at least one third adjustment thin-film transistor, wherein the at least one third adjustment thin-film transistor is disposed outside the second test region and adjacent to the fourth side of the second test region, and the at least one third adjustment thin-film transistor is disconnected with the display region.

10. The liquid crystal display panel as claimed in claim 9, further comprising at least one third adjustment line having a terminal, wherein the terminal of the at least one third adjustment line is connected to the at least one third adjustment thin-film transistor.

11. The liquid crystal display panel as claimed in claim 1, wherein the width of the blank region is substantially larger than 1.4 times the width of the pitch.

12. The liquid crystal display panel as claimed in claim 1, wherein the width of the blank region is substantially larger than 18 μm.

13. The liquid crystal display panel as claimed in claim 1, wherein the width of the pitch is substantially from 12 μm to 17 μm.

* * * * *